US008479811B2

(12) United States Patent
Furui et al.

(10) Patent No.: US 8,479,811 B2
(45) Date of Patent: Jul. 9, 2013

(54) COMPACTION TOLERANT BASEPIPE FOR HYDROCARBON PRODUCTION

(75) Inventors: Kenji Furui, Pearland, TX (US); Giin-Fa Fuh, Katy, TX (US); Srinagesh K. Marti, Katy, TX (US); Luke Forrester Eaton, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 240 days.

(21) Appl. No.: 12/749,791

(22) Filed: Mar. 30, 2010

(65) Prior Publication Data

US 2010/0243239 A1 Sep. 30, 2010

Related U.S. Application Data

(60) Provisional application No. 61/165,304, filed on Mar. 31, 2009.

(51) Int. Cl.
*E03B 3/18* (2006.01)

(52) U.S. Cl.
USPC ..... 166/233

(58) Field of Classification Search
USPC ..... 166/233, 242.1, 384, 235; 138/118.1, 138/119, 110
See application file for complete search history.

(56) References Cited

U.S. PATENT DOCUMENTS 1,499,382 A * 7/1924 Layne ..... 166/233
3,071,942 A * 1/1963 Alcaro ..... 464/78
3,399,548 A * 9/1968 Burns ..... 464/18
3,844,137 A * 10/1974 Zugel ..... 464/78
3,844,347 A * 10/1974 Stotzel et al. ..... 166/227
4,018,283 A * 4/1977 Watkins ..... 166/278
4,416,331 A * 11/1983 Lilly ..... 166/236
4,858,897 A * 8/1989 Irifune ..... 267/181
5,041,060 A * 8/1991 Hendershot ..... 464/86
5,320,178 A 6/1994 Cornette
5,975,208 A * 11/1999 Brooks ..... 166/313
5,992,518 A * 11/1999 Whitlock ..... 166/235
6,158,510 A * 12/2000 Bacon et al. ..... 166/272.7
6,203,437 B1 * 3/2001 Durie et al. ..... 464/78
6,337,142 B2 * 1/2002 Harder et al. ..... 428/573
6,675,893 B2 1/2004 Lund
6,715,545 B2 * 4/2004 McGregor et al. ..... 166/235
6,749,024 B2 6/2004 Bixenman
6,769,484 B2 8/2004 Longmore
6,837,308 B2 1/2005 Michel
7,213,655 B2 * 5/2007 Parrott ..... 166/380
7,249,631 B2 7/2007 Rouse et al.

(Continued)

OTHER PUBLICATIONS

Morita, N. et al. "Collapse Resistance of Tubular Strings Under Geotectonic Load" paper SPE 95691 presented at the 2005 SPE ATCE held in Dallas, Texas, Oct. 9-12, 2005.

(Continued)

*Primary Examiner* — Kenneth L Thompson
*Assistant Examiner* — Michael Wills, III
(74) *Attorney, Agent, or Firm* — ConocoPhillips Company

(57) ABSTRACT

The invention relates to base pipe with slots cut into the peripheral wall to form compaction absorber segments that are arranged to permit the base pipe to be compacted in length without buckling or transferring excessive compressive forces to other pipe sections when a poorly consolidated formation shrinks due to production from the formation. Over time, the slots close as the base pipe shrinks in length and production continues through conventional holes in the base pipe.

6 Claims, 3 Drawing Sheets

U.S. PATENT DOCUMENTS

| | | | | |
|---|---|---|---|---|
| 7,407,013 | B2 | 8/2008 | Whitsitt | |
| 2005/0241709 | A1 * | 11/2005 | Johnson et al. | 138/28 |
| 2007/0039741 | A1 | 2/2007 | Hailey, Jr. | |
| 2007/0114027 | A1 | 5/2007 | Yeh et al. | |
| 2008/0035330 | A1 | 2/2008 | Richards | |
| 2012/0048416 | A1 * | 3/2012 | Hagen | 138/140 |

OTHER PUBLICATIONS

King, G.E. et al. "Sand Control Completion Reliability and Failure Rate Comparison with a Multi-Thousand Well Database" paper SPE 84262, 2003 ATCE held in Denver, Colorado, Oct. 5-8, 2003.

Rapello dos Santos and Perez da Silva, "Collapse Analysis of Screens Used in Horizontal Open Hole Gravel Pack Completion" paper SPE 112506-MS, SPE International Symposium and Exhibition on Formation Damage Control, Feb. 13-15, 2008, Lafayette, Louisiana, USA.

Li, et al., "Compaction Considerations for the Gulf of Mexico Deepwater King West Field Completion Design" paper SPE 92652-MS presented at the SPE/IADC Drilling Conference, Feb. 23-25, 2005, Amsterdam, Netherlands.

* cited by examiner

COMPACTION TOLERANT BASEPIPE FOR HYDROCARBON PRODUCTION

CROSS-REFERENCE TO RELATED APPLICATIONS

This application is a non-provisional application which claims benefit under 35 USC §119(e) to U.S. Provisional Application Ser. No. 61/165,304 filed Mar. 31, 2009, entitled "Compaction Tolerant Basepipe for Hydrocarbon Production," which is incorporated herein in its entirety.

STATEMENT REGARDING FEDERALLY SPONSORED RESEARCH OR DEVELOPMENT

None.

FIELD OF THE INVENTION

This invention relates to base pipe which is used in a production tubing/liner string in a fluid production well and especially a hydrocarbon production well where the base pipe is positioned in the proximity of the fluid production formation and has holes and typically a screen around the base pipe to allow the fluid into the production string while substantially excluding sand and other solid particles.

BACKGROUND OF THE INVENTION

Prior to extracting fluids from a downhole formation, the fluids occupy space within the formation. In the process of producing fluids from a formation, the fluid pressure will generally decline. Reduced pore pressure in the reservoir rock will increase the effective stress and thereby cause the rock itself to shrink, and thus the reservoir will compact. Reservoir compaction may then cause subsidence at the surface. Subsidence is a substantial concern in the production of hydrocarbons, especially where the formation is comprised of unconsolidated sands or does not have significant structural integrity. Offshore platforms mounted to the seafloor and arranged to stand well above sea level and above any wave action at the sea surface have settled toward the sea because of subsidence. Actually, the amount of subsidence could be alarming if a substantial safety zone wasn't established in the design phase of the well development plan and such subsidence has been measured in as much as tens of feet.

The thickness of the producing zone typically diminishes to some extent during production of well fluids, but in poorly consolidated sands and high porosity rocks may diminish by a substantial amount such as about 10% over the life of the production operation. Compaction of the producing zones exerts powerful forces on equipment and pipe in the well. Conventional base pipe is subject to buckling when the compaction of the production string is less than 2 to 3% with relatively good lateral confinement supports and it is likely that the well will have to be abandoned or recompleted if the production string has buckled.

SUMMARY OF THE INVENTION

The invention more particularly includes a base pipe for use in a wellbore to tolerate compaction of the production zone where the base pipe includes an elongated generally cylindrical hollow body with an upper end, a lower end, a peripheral exterior wall and in interior space and at least one connector at the upper end for connecting to production tubing or liner. The base pipe further includes holes in the peripheral wall through which production fluid may pass from the outside of the base pipe into the interior space and screen mesh mounted around the peripheral wall to prevent sand and other particles from being carried by production fluids through the holes in the peripheral wall and into the interior space. Additionally, the base pipe includes compaction absorber segments spaced along the generally cylindrical hollow body to absorb longitudinal stresses and reduce the length of the elongated generally cylindrical hollow body.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Turning now to the preferred arrangement for the present invention, reference is made to the drawings to enable a more clear understanding of the invention. However, it is to be understood that the inventive features and concept may be manifested in other arrangements and that the scope of the invention is not limited to the embodiments described or illustrated. The scope of the invention is intended only to be limited by the scope of the claims that follow.

Figure 1:
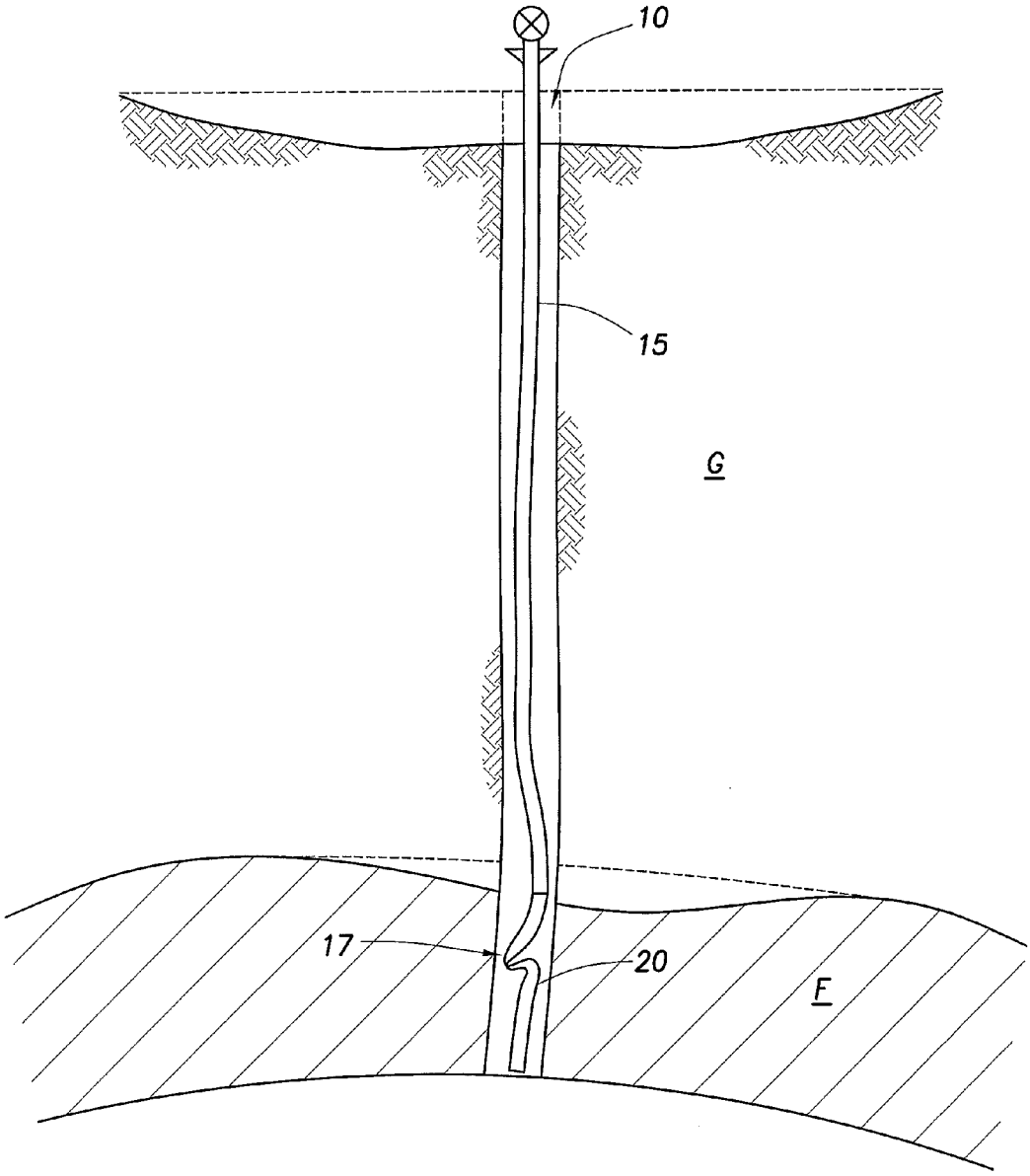
FIG. 1 is a fragmentary cross sectional view of a wellbore undergoing the stresses and illustrating a failure of a drillstring with conventional base pipe.

Turning now to FIG. 1, a wellbore is generally indicated by the arrow 10 and extends deep into the ground G and into hydrocarbon bearing formation F. A drill string comprising pipe 15 extends down into wellbore 10 with base pipe 20 attached at the lower end. The screens and screen base pipes can be run as a part of production liner separately from the tubing string. Base pipe 20 includes holes that are not shown and a wire wrapped screen surrounding the base pipe 20 to keep sand and other solids out of the production string. Within the production string is a pump may be arranged to pump liquids to the surface for transporting to a refinery.

As fluid from formation F is withdrawn to the surface 12, the thickness of formation F may shrink over time as shown by the reduced vertical dimension of formation F in the proximity of base pipe 20. The upper portion of the formation F has subsided along with the layers of earth over top of the formation so that the surface actually sinks or subsides. The subsidence exerts a substantial amount of compression on the length of the production string and can force a buckle as shown at 17 in the pipe 15 effectively closing off the production string and stopping or severely limiting further production.

Figure 2:
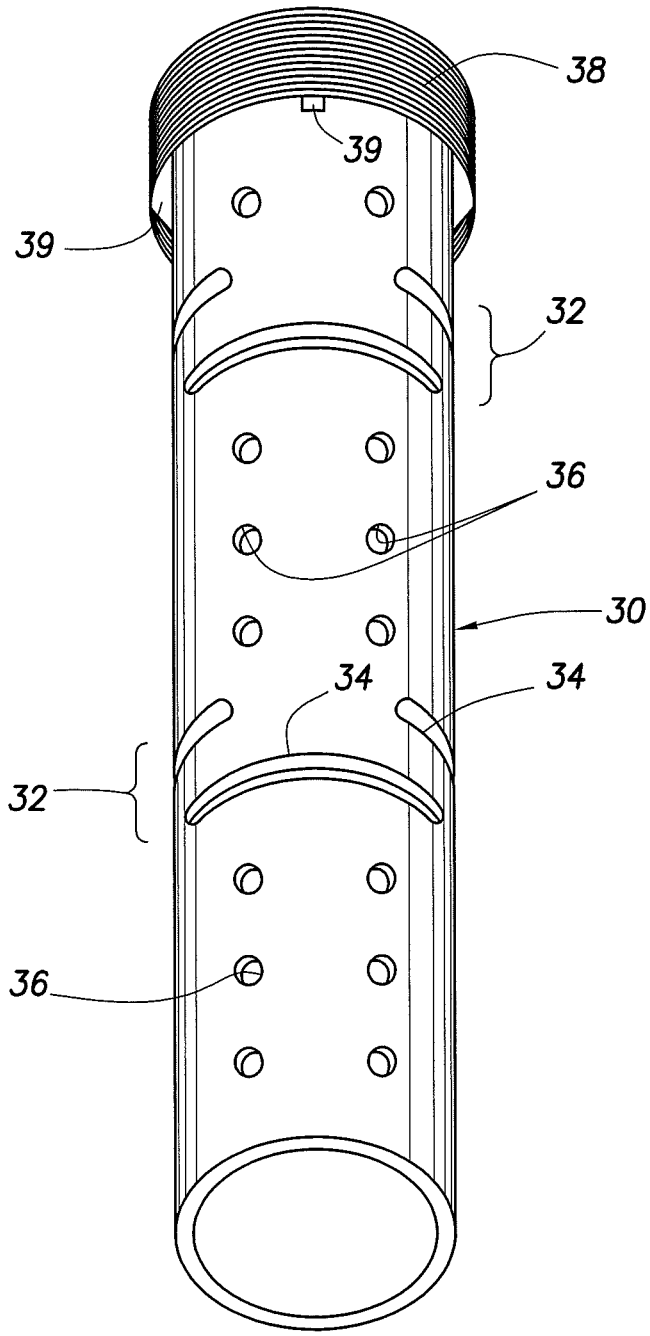
FIG. 2 is a fragmentary perspective view of the base pipe of the present invention.

Turning now to FIG. 2, a section of compaction tolerant base pipe 30 is shown with compaction absorber segments 32. The compaction absorption segments are comprised of cross cut slots 34 that extend for a substantial portion of a circumferential arc of the pipe 30. Preferably, each cross cut slot 34 extends for about 120 degrees or about ⅓ of the circumference of the pipe 30 and are perpendicular to the axis of the pipe 30. However, the compaction absorber segments 32 include a number of overlapping cross cut slots 34 that will work together to preferential collapse the length of the base pipe 30 without buckling or conveying excessive compressive forces up the production string to a weak point where a buckling failure or other failure may occur.

The overlaps of slots 34 are preferably at least 50% the circumferential length of the tangential cuts and spaced apart by two to three times the width of the cross cuts. While the compaction absorber segments 32 are intended to accommodate the reduction in length of the base pipe 30, they are also intended to maintain necessary strength parameters in other respects. The base pipe 30 of the present invention must retain sufficient compressive and tensile strength to be put into and withdrawn from wellbore 10 in the event the production string must be withdrawn and re-installed. Also, the base pipe 30 must have sufficient radial strength to resist forces that would tend to collapse the base pipe and close the hollow space through which fluids are produced to the surface.

It should be understood that base pipe 30 includes conventional holes 36 and a screen such as wire wrap screen 38. Wire wrap screen 38 is removed from the end of the base pipe 30 to reveal the holes 36 and slots 34, but in practice would cover the portions of base pipe 30 that would include any openings Base pipe 30 would preferably include screw threads at each end or at the top end to connect to other lengths of base pipe in a large producing formation and to the conventional production tubing to form the production string. The bottom end of the base pipe 30 is typically closed, but may be open with screen or other mesh to prevent sand and other solids from entering the hollow interior of the base pipe 30.

Figure 3:
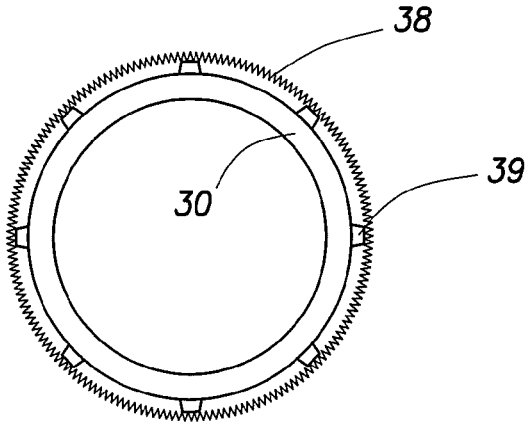
FIG. 3 is a cross sectional end view of the base pipe of the present invention.

FIG. 3 shows the wire wrapped screen 38 surrounding base pipe 30 with spacers 39 attached to the outside of the peripheral wall of base pipe 30 to create a space for fluids to pass fully through the screen 38 and then move toward holes 36. It should be understood that the wire wrapped screen 38 may also be closely attached to base pipe 30 without spacers, if desired.

Figure 4:
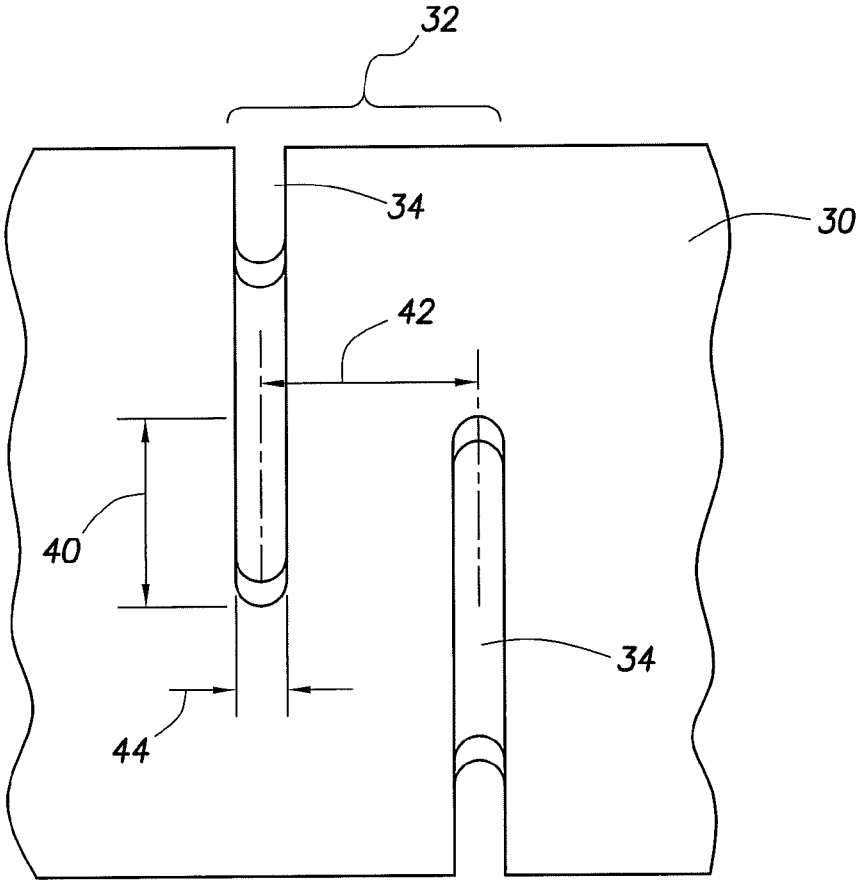
FIG. 4 is an enlarged, fragmentary side view of the base pipe particularly illustrating a compaction absorber segment.

In FIG. 4, the compaction absorber segments 32 are more clearly illustrated where it can be seen that each of the slots 34 have a dimension called slot width 44. Also, the slots 34 are spaced by a dimension called slot spacing 42 and overlap one another by a dimension called slot overlap 40. With the slot overlap 40, slot spacing 42 and slot width 40, some relative ratios can be identified. For example, it is preferred for the slot spacing to be at least two times the slot width and preferably at most four times the slot width.

The segments 32 are illustrated with four perfectly transverse slots, but three, four, five or six or more substantially transverse slots that overlap with suitable slot width and slot overlap to slot spacing ratios may perform adequately. In this example, the slots are cut slightly offline from the circumference of the base pipe 30 such that each slot overlaps one adjacent slot closer to the bottom end of the base pipe while the other end overlaps the other adjacent slot closer to the top end of the base pipe. Also, it should be understood that six or eight nearly transverse overlapping slots may be used for reservoirs that are highly likely to compact during fluid production.

It is preferred that each slot is at least three millimeters in width and up to about ten millimeters in width.

Another parameter of the base pipe of the present invention is segment spacing which is the distance one compaction absorber segment 32 is from the next adjacent compaction absorber segment 32. While the spacing may be irregular, it is preferred that the segment spacing would be less than four times the diameter of the base pipe 30 and more preferably less than three times the diameter. At the same time, it is preferred that the segment spacing is at least the diameter of the base pipe 30 and more preferably at least twice the diameter of the base pipe 30.

Finally, the scope of protection for this invention is not limited by the description set out above, but is only limited by the claims which follow. That scope of the invention is intended to include all equivalents of the subject matter of the claims. Each and every claim is incorporated into the specification as an embodiment of the present invention. Thus, the claims are part of the description and are a further description and are in addition to the preferred embodiments of the present invention. The discussion of any reference is not an admission that it is prior art to the present invention, especially any reference that may have a publication date after the priority date of this application.

The invention claimed is:

1. A base pipe for use in a wellbore to tolerate compaction of the production zone where the base pipe comprises:

a) an elongated generally cylindrical hollow body of the base pipe with an upper end, a lower end, a peripheral exterior wall and an interior space;

b) at least one connector at the upper end for connecting the base pipe to production tubing or liner;

c) holes in the peripheral wall of the base pipe through which production fluid may pass from the outside of the base pipe into the interior space;

d) screen mesh mounted around the peripheral wall of the base pipe to prevent sand and other particles from being carried by production fluids through the holes in the peripheral wall and into the interior space; and e) compaction absorber segments integral within the base pipe spaced along the generally cylindrical hollow body of the base pipe to absorb longitudinal stresses and reduce the length of the elongated generally cylindrical hollow body.

2. The base pipe according to claim 1 wherein the compaction absorber segments comprise a plurality of generally transverse slots cut into the elongated generally cylindrical hollow body.

3. The base pipe according to claim 2 wherein the generally transverse slots cut into the elongated generally cylindrical hollow body are overlapping by at least 75% of the dimension that the transverse slots are space apart longitudinally.

4. The base pipe according to claim 3 wherein the transverse slots are arranged to preferentially close when the base pipe is reduced in length by compressive forces while the holes are sized and designed to resist the same compressive forces and remain open and continue to permit production fluids to enter the interior space from outside the base pipe.

5. The base pipe according to claim 4 wherein the transverse slots are overlapping by at least 100% of the dimension that the transverse slots are space apart longitudinally.

6. The base pipe according to claim 1 wherein the transverse slots are arranged to extend perpendicular to the longitudinal axis of the base pipe.

* * * * *